US005858931A

United States Patent [19]

Tanaka et al.

[11] Patent Number: 5,858,931

[45] Date of Patent: Jan. 12, 1999

[54] LUBRICATING COMPOSITION

[75] Inventors: Noriyoshi Tanaka; Aritoshi Fukushima; Yukio Tatsumi; Kazuhisa Morita; Yoko Saito, all of Tokyo, Japan

[73] Assignee: Asahi Denka Kogyo K.K, Japan

[21] Appl. No.: 692,462

[22] Filed: Aug. 5, 1996

[30] Foreign Application Priority Data

| | | | |
|---|---|---|---|
| Aug. 9, 1995 | [JP] | Japan | 7-203625 |
| Aug. 23, 1995 | [JP] | Japan | 7-215031 |
| Sep. 20, 1995 | [JP] | Japan | 7-241886 |

[51] Int. Cl.[6] ..... C10M 141/02; C10M 141/06; C10M 141/10

[52] U.S. Cl. ..... 508/364; 508/365; 508/370; 508/376; 508/378; 508/379

[58] Field of Search ..... 508/364, 365, 508/377, 378, 431, 432, 379, 370, 487, 216

[56] References Cited

U.S. PATENT DOCUMENTS

| | | | |
|---|---|---|---|
| 3,103,494 | 9/1963 | Spengler et al. | 508/227 |
| 3,290,245 | 12/1966 | Scotchford et al. | 508/362 |
| 3,426,738 | 2/1969 | Goodwine, Jr. | 508/579 |
| 3,876,550 | 4/1975 | Holubec | 508/263 |
| 3,888,776 | 6/1975 | Silverstein | 252/25 |
| 4,151,099 | 4/1979 | Nasry et al. | 508/379 |
| 4,383,931 | 5/1983 | Ryu et al. | 508/342 |
| 4,402,840 | 9/1983 | de Vries | 508/362 |
| 4,474,673 | 10/1984 | Hunt et al. | 508/572 |
| 4,529,526 | 7/1985 | Inoue et al. | 508/379 |
| 4,606,833 | 8/1986 | Schuettenberg et al. | 508/431 |
| 4,692,256 | 9/1987 | Umemura et al. | 508/362 |
| 4,758,362 | 7/1988 | Butke | 508/229 |
| 4,832,867 | 5/1989 | Seiki et al. | 508/364 |
| 4,966,719 | 10/1990 | Coyle et al. | 508/445 |

FOREIGN PATENT DOCUMENTS

| | | |
|---|---|---|
| 0 205 165 | 12/1986 | European Pat. Off. . |
| 0 435 745 | 12/1990 | European Pat. Off. . |
| 52-016 503 | 7/1977 | Japan . |
| 59-25890 | 2/1984 | Japan . |
| 59-025 890 | 9/1984 | Japan . |
| 5-279 686 | 10/1993 | Japan . |
| 5-279686 | 10/1993 | Japan . |
| 5-311186 | 11/1993 | Japan . |
| 6-184 583 | 7/1994 | Japan . |
| 6-313 184 | 11/1994 | Japan . |
| 882 295 | 4/1960 | United Kingdom . |
| 867 544 | 5/1961 | United Kingdom . |

*Primary Examiner*—Margaret Medley
*Attorney, Agent, or Firm*—Wenderoth, Lind & Ponack, L.L.P.

[57] ABSTRACT

A lubricating composition of the present invention comprises a base oil for lubricating oil or base grease; at least one molybdenum compound as component (A) selected from the group consisting of a selected sulfurized oxymolybdenum dithiocarbamate, a selected sulfurized oxymolybdenum dithiophosphate and a selected molybdenum amine compound; and a (poly)glycerol ether and/or a (poly) oxyalkylene glycol monoalkyl ether as component (B).

16 Claims, No Drawings

LUBRICATING COMPOSITION

BACKGROUND OF THE INVENTION

1. Field of the Invention

The present invention relates to lubricating compositions. In particular, the present invention relates to a lubricant composition obtained by compounding molybdenum dithiocarbamate, molybdenum dithiophosphate, and/or a molybdenum amine compound; and a (poly)glycerol ether and/or a (poly)oxyalkylene glycol monoalkyl ether, in a base oil. More particularly, the present invention relates to a lubricating oil composition which exhibits excellent stability to hydrolysis and excellent friction reduction even after deterioration with water, and a grease which is used for universal joints including constant velocity joints (CVJ) for automobiles, constant velocity gears, and transmission gears, and which has excellent friction and abrasion properties.

2. Description of the Related Art

The automotive field is today confronted with strict fuel regulations, and exhaust gas regulations, etc. against the background of environmental pollution, e.g. global greenhouse effect, air pollution, and acid rain, and in order to preserve limited petroleum resources from exhaustive use. Improvements in mileage are the most effective way to respond to such regulations at present.

Improvements in engine oil, such as low viscosity engine oils and the addition of friction modifiers, as well as improvements in automobiles themselves, e.g. light weight vehicles and improved engines, are important means for achieving low fuel consumption in the automotive field. Engine oil acts as a lubricant between pistons and liners, and friction loss can be reduced by decreasing the viscosity of the engine oil due to the high fluid lubrication in this portion. However, the decreases in oil viscosity in recent years have also created such problems as deteriorated sealing properties and accelerated wear. Engine oil also plays an important role in the valve train and bearings. Low viscosity oil will cause increased wear due to mixed lubrication or boundary lubrication in these systems. Friction modifiers and extreme pressure agents are added to the oil to decrease friction and prevent wear.

Generally used friction modifiers include, for example, higher fatty acids, e.g. oleic acid and stearic acid; higher alcohols, e.g. oleyl alcohol; esters; amines; sulfide oils; chlorinated oils; and organic molybdenum compounds. Generally used extreme pressure agents include, for example, sulfide oils; sulfur compounds, e.g. sulfides; phosphorous compounds; and organic metals e.g. zinc dithiophosphate (ZnDTP).

For example, Japanese Laid-Open Patent No. 59-25890 discloses glycerin monoalkyl ether or glycerin monoalkenyl ether as the friction modifier, as well as a common lubricant composition produced by combining ZnDTP with an ash-free detergent-dispersant.

The addition of organic molybdenum friction modifiers providing low friction in mixed or boundary lubrication is inevitable in order to solve all the problems associated with the lowering of lubricating oil viscosity. Japanese Laid-Open Patent No. 5-279686 proposes an improvement in frictional properties without deterioration in other properties such as abrasion resistance by compounding an organic molybdenum compound; a fatty acid ester; a metallic detergent, such as calcium sulfonate, magnesium sulfonate, calcium phenate, and magnesium phenate; an ash-free detergent-dispersant, such as benzylamine and its boron derivative, and alkenylsuccinic imide and its boron derivative; and wear improvers such as ZnDTP and zinc dithiocarbamate (ZnDTC).

Alternatively, Japanese Laid-Open Patent No. 5-311186 discloses a drastic decrease in the friction coefficient of lubricating oil which contains a combination of a metal dithiocarbamate and an oil-soluble amine; sulfoxy molybdenum dithiocarbamate and/or sulfoxy molybdenum organophosphorodithioate; and a fatty acid ester and/or organic amides, in a selected ratio.

However, neither of the compositions disclosed in Japanese Laid-Open Patent Nos. 5-279686 and 5-311186 show reduced friction when oil contains water even with the addition of the molybdenum compound.

Inclusion of water in an engine oil formed during fuel combustion is inevitable. In particular, when engine oil is not heated, that is during repeated short distance operation cycles water content in the engine oil increases as the water does not evaporate. Water causes not only deterioration of the additives but also the activation of blow-by gas, resulting in significantly adverse effects on the engine oil. Thus, the development of an oil which can maintain decreased friction while maintaining fuel saving performance with little deterioration even when water is included has been needed.

Recently, CVJs have been widely employed for front engine front drive vehicles, four wheel drive vehicles, and front engine rear drive vehicles with independent suspension. CVJs are used to transmit power from the engine to the wheels, and the power must be smoothly transmitted even during steering. Thus, a CVJ generally consists of a combination of a plunging-type joint at the engine side capable of sliding in the axial direction and a fixed-type joint fixed in the axial direction at the wheel side. Since the sliding friction in the rotational direction occurs through the rolling-sliding motion during the reciprocating motion in the plunging-type joint, various noises and vibrations, e.g. vibrations during idling in an automatic transmission vehicle, lateral vibration during starting and accelerating, beat oscillations at certain speeds, and booming occur. Decreased vibration is an important issue to be solved for the development of more comfortable and quieter vehicles. Thus, not only has the joint itself been improved to decrease such vibrations, but the grease filled in the joint as well.

As there is a correlation between the vibration and the friction coefficient, and further as reduced fuel consumption is increasingly demanded, greases for providing decreased friction are being sought.

Molybdenum disulfide, sulfur-phosphorous additives, and lead additives have been conventionally used in grease for CVJs. Recently, organic molybdenum compounds have been used instead of the above additives, in order to produce grease exhibiting lower vibration or lower friction. Japanese Laid-Open Patent No. 6-184583 discloses a grease composition for CVJs comprising a urea grease, molybdenum dithiophosphate, molybdenum dithiocarbamate, and ZnDTC. Additionally, Japanese Laid-Open Patent No. 4-178499 discloses a grease composition for CVJs comprising a urea thickener, sulfurized molybdenum dialkyldithiocabamate, zinc dithiophosphate, and sorbitan fatty acid esters.

Although, long drain lubricating oils are now desirable with the aim of achieving a maintanance free lubricating composition, it is becoming an important problem to maintain this in addition to reduced fuel consumption. Engine oils undergo the most severe oxidative deterioration among lubricating oils, and the deterioration starts with the running of the vehicles. Additives also deteriorate along with this oil deterioration. Thus, improvements in the additives are also essential for maintaining the fuel saving properties of lubricating oil. That is, because the use of oil-soluble molybdenum compounds is essential for fuel savings, it is even more important to effectively draw out and maintain the properties of the molybdenum compounds.

Further, the friction of the grease compositions set forth above is not satisfactory and must be further lowered. Demand on greases has shifted to increasingly severe site conditions due to the decreased quantity of grease fillable in smaller and light weight CVJs, higher power output and higher vehicle speeds. Thus, low frictional performance is required for such greases in addition to high durability and high friction resistance.

SUMMARY OF THE INVENTION

It is an object of the present invention to provide a lubricating composition suitable for lubricating oil or grease.

In accordance with the present invention, a lubricating composition comprising:

a component (A) comprising at least one molybdenum compound selected from the group consisting of sulfurized oxymolybdenum dithiocarbamates (hereinafter "MoDTC") represented by the following general formula:

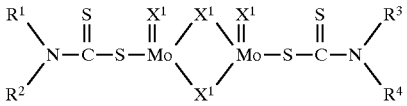

(1)

(wherein $R^1$, $R^2$, $R^3$ and $R^4$ are independent hydrocarbly groups, and $X_1$ represents an oxygen or sulfur atom);

sulfurized oxymolybdenum dithiophosphates (hereinafter "MoDTP") represented by the following general formula:

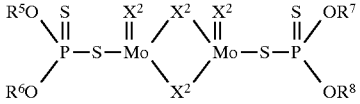

(2)

(wherein $R^5$, $R^6$, $R^7$ and $R^8$ are independent hydrocarbly groups, and $X^2$ represents an oxygen or sulfur atom); and molybdenum amine compounds (hereinafter "MoAm") obtained by reacting a hexavalent molybdenum compound with an amine compound represented by the following general formula:

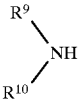

(3)

(wherein both $R^9$ and $R^{10}$ represent a hydrogen atom and/or hydrocarbyl group, and $R^9$ and $R^{10}$ are not hydrogen atoms at the same time): and a component (B) comprising a (poly)glycerin ether represented by the following general formula:

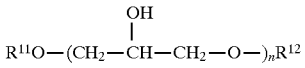

(4)

(wherein both $R^{11}$ and $R^{12}$ represent a hydrogen atom and/or hydrocarbyl group, $R^{11}$ and $R^{12}$ are not hydrogen atoms at the same time, and n ranges from 1 to 10); and/or a (poly)oxyalkylene glycol monoalkyl ether represented by the following general formula:

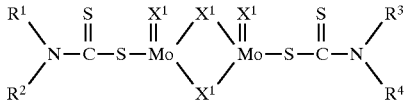

(5)

(wherein $R^{13}$ represents a hydrocarbyl group, $R^{14}$ represents an alkylene group, and m ranges from 1 to 10).

A second embodiment of the present invention provides a lubricating composition comprising:

a component (A) comprising at least one molybdenum compound selected from the group consisting of MoDTC represented by the following general formula:

(1)

(wherein $R^1$, $R^2$, $R^3$, $R^4$ and $X^1$ have the same meanings as described above);

MoDTP represented by the following general formula:

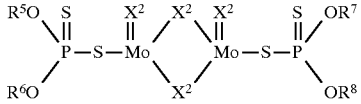

(2)

(wherein $R^5$, $R^6$, $R^7$, $R^8$ and $X^2$ have the same meanings as described above); and MoAm obtained by reacting a hexavalent molybdenum compound with an amine compound represented by the following general formula:

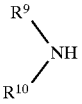

(3)

(wherein $R^9$ and $R^{10}$ have the same meanings as described above):

a component (B) comprising a (poly)glycerin ether represented by the following general formula:

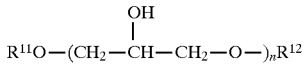

(4)

(wherein $R^{11}$, $R^{12}$, and n have the same meanings as described above); and/or a (poly)oxyalkylene glycol monoalkyl ether represented by the following general formula:

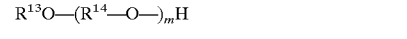

(5)

(wherein $R^{13}$, $R^{14}$ and m have the same meanings as described above): and a component (C) comprising a ZnDTP represented by the following general formula:

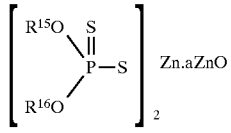

(6)

(wherein a represents a figure of zero or one-third, and both $R^{15}$ and $R^{16}$ represent a hydrocarbyl group); and/or a zinc dithiocarbamates (hereinafter "ZnDTC") represented by the following general formula:

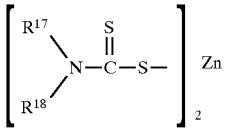

(7)

(wherein both $R^{17}$ and $R^{18}$ represent a hydrocarbyl group).

DESCRIPTION OF PREFERRED EMBODIMENT

The molybdenum compounds as the essential component (A) in the lubricating composition according to the present invention include MoDTCs represented by the general formula (1) set forth above, MoDTPs represented by the general formula (2), and MoAms. These molybdenum compounds can be used alone or in combination.

In general formulae (1) to (3), $R^1$ through $R^{10}$ are independent hydrocarbyl groups, e.g. alkyl, alkenyl, alkylaryl, cycloalkyl, cycloalkenyl group, or the like.

Examples of alkyl groups include methyl, ethyl, propyl, isopropyl, butyl, isobutyl, tert-butyl, pentyl, isopentyl, neopentyl, tert-pentyl, hexyl, heptyl, octyl, 2-ethylhexyl, nonyl, decyl, undecyl, dodecyl, tridecyl, isotridecyl, myristyl, palmityl, stearyl, eicosyl, docosyl, tetracosyl, triacontyl, 2-octyldodecyl, 2-dodecylhexadecyl, 2-tetradecyloctadecyl, and monomethyl- branched isostearyl groups.

Examples of alkenyl groups include vinyl, allyl, propenyl, isopropenyl, butenyl, isobutenyl, pentenyl, isopentenyl, hexenyl, heptenyl, octenyl, nonenyl, decenyl, undecenyl, dodecenyl, tetradecenyl, and oleyl groups.

Examples of alkylaryl groups include phenyl, tolyl, xylyl, cumenyl, mesityl, benzyl, phenethyl, styryl, cinnamyl, benzhydryl, trityl, ethylphenyl, propylphenyl, butylphenyl, pentylphenyl, hexylphenyl, heptylphenyl, octylphenyl, nonylphenyl, α-naphthyl, and β-naphthyl groups.

Examples of cycloalkyl and cycloalkenyl groups include cyclopentyl, cyclohexyl, cyclobutyl, methylcyclopentyl, methylcyclohexyl, methylcycloheptyl, cyclopentenyl, cyclohexenyl, cycloheptenyl, methylcyclopentenyl, methylcyclohexenyl, and methylcycloheptenyl.

Both $R^9$ and $R^{10}$ can be a hydrogen atom, but cannot be a hydrogen atom at the same time.

$R^1$ through $R^{10}$ may be the same or different from each other. Thus, $R^1$ through $R^4$, $R^5$ through $R^8$, and $R^9$ through $R^{10}$ may be the same or different from each other. When $R^1$ through $R^4$ are different from each other, the life of the lubricating composition can be prolonged.

When the lubricating compositions according to the present invention are compounded in a conventionally used base oil for lubricating oil as a lubricating oil composition, $R^1$ through $R^4$ in MoDTC represented by the general formula (1) are each preferably an alkyl group having 8 to 13 carbon atoms, $R^5$ through $R^8$ in MoDTP represented by the general formula (2) are each preferably an alkyl group having 6 to 13 carbon atoms, and $R^9$ through $R^{10}$ in MoAm represented by the general formula (3) are each preferably an alkyl group having 6 to 18 carbon atoms.

The lubricating composition according to the present invention can also be compounded in a base grease comprising a base oil and a thickener. In such a case, $R^1$ through $R^4$, $R^5$ through $R^8$, and $R^9$ and $R^{10}$ are each preferably an alkyl group having 1 to 16 carbon atoms, more preferably 2 to 13 carbon atoms, and most preferably 2 to 8 carbon atoms.

Both $X^1$ and $X^2$ in MoDTC represented by the general formula (1) and MoDTP represented by the general formula (2) may each be a sulphur or oxygen atom. Although both $X^1$ and $X^2$ can be only sulfur atoms or only oxygen atoms, it is preferable that the sulfur/oxygen atomic ratio ranges from 1/3 to 3/1 in view of lubricating properties and corrosion resistance.

The MoDTC represented by the general formula (1) used in the present invention can be preferably synthesized by the method described in, for example, Japanese Patent Publication No. 56-12638, in which the MoDTC is obtained by reacting molybdenum trioxide or a molybdate with an alkaline metal sulfide or alkaline metal hydrosulfide, and then by reacting the resultant with carbon dioxide and a secondary amine at an adequate temperature.

The MoDTP represented by the general formula (2) used in the present invention can be preferably synthesized by the method described in, for example, Japanese Patent Laid-Open Nos. 61-87690 and 61-106587, in which the MoDTP is obtained by reacting molybdenum trioxide or a molybdate with an alkaline metal sulfide or alkaline metal hydrosulfide, and then by reacting the resultant with $P_2S_5$ and a secondary alcohol at an adequate temperature.

The MoAm used in the present invention is a salt of a molybdic acid ($H_2MoO_4$) with a primary or secondary amine, and is preferably synthesized by the method disclosed in, for example, Japanese Patent Laid-Open No. 61-285293, in which the MoAm is obtained by reacting a hexavalent molybdenum compound, e.g. molybdenum trioxide or a molybdate, with a primary or secondary amine represented by the following general formula (3) at a temperature ranging from room temperature to 100° C.:

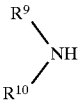

(3)

Although the chemical formula of the MoAm obtained by the reaction set forth above is not clear, it will probably be as follows:

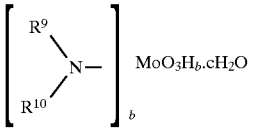

(8)

(wherein b is within a range of $0.95 \leqq b \leqq 1.05$, and c is within a range of $0 \leqq c \leqq 1$).

When a base oil for lubricating oil is used in the lubricating composition according to the present invention, the molybdenum compounds as component (A) may be at least one compound of MoDTC, MoDTP, and MoAm. When two or more compounds are used together, at least one compound among them is preferably MoDTC. Although the content of the added molybdenum compound is not limited, it is preferably 0.001 to 1 wt % as reduced molybdenum amount, more preferably 0.005 to 0.5 wt %, and most preferably 0.01 to 0.1 wt % of the base oil, because an extremely low content does not sufficiently lower friction, whereas an excessive content causes slag formation and corrosion.

When a base grease is used in the lubricating composition according to the present invention, the molybdenum compound as component (A) may be at least one compound of MoDTC, MoDTP, and MoAm. When two or more compounds are used together, at least one compound among them is preferably MoDTC. Although the content of the added molybdenum compound is not limited, it is preferably 0.01 to 10 wt %, and more preferably 1 to 5 wt % of the base grease, because an extremely low content does not sufficiently lower friction, whereas an excessive content does not further improve grease properties, but may be harmful to the grease.

In the lubricating composition according to the present invention, the compound represented by the general formula (4) as component (B) is a (poly)glycerin ether. In the general formula (4), $R^{11}$ and $R^{12}$ are each a hydrogen atom or a hydrocarbyl group, both may be the same or different from each other, and both are preferably alkyl, alkenyl, or alkylaryl groups, similar to $R^1$ through $R^{10}$ as described above, but both $R^{11}$ and $R^{12}$ cannot be hydrogen atoms at the same time.

$R^{11}$ and $R^{12}$ are each preferably a hydrogen atom or a straight chain or branched chain alkyl or alkenyl group having 1 to 20 carbon atoms, and more preferably a straight chain or branched chain alkyl or alkenyl group having 12 to 20 carbon atoms. In particular, a straight chain alkyl or alkenyl group, e.g. a lauryl, oleyl, stearyl group, are preferable.

Further, n ranges from 1 to 10, in other words, the compound may be a monoglycerin ether or polyglycerin ether. As a compound having a larger n is difficult to synthesize, n ranges preferably from 1 to 3.

The compound represented by the general formula (5) is a (poly)oxyalkyleneglycol ether. $R^{13}$ in the general formula (5) is a hydrocarbyl group, preferably a straight chain or branched chain alkyl, alkenyl, or alkylaryl group, similar to $R^1$ through $R^{10}$ as described above, and more preferably a linear group. In detail, an alkyl or alkenyl group having 1 to 20 carbon atoms is preferable, an alkyl or alkenyl group having 12 to 20 carbon atoms is more preferable, and a lauryl or oleyl group is the most preferable.

$R^{14}$ is an alkylene group, preferably an alkylene group having 2 to 4 carbon atoms, e.g. an ethylene, propylene, or butylene group. The $(R^{12}—O)_m$ portion is obtained by adding ethylene oxide, propylene oxide, butylene oxide or the like. An addition reaction of alkylene oxide may be homopolymerization, or random or block copolymerization.

Further, m ranges from 1 to 10, in other words, the compound may be a monooxyalkyleneglycol ether or polyoxyalkyleneglycol ether. As a the compound having a larger m decreases the solubility to oil and thermal stability, m is preferably 1 to 5, and more preferably 2 to 4.

When a base oil for lubricating oil is used in the lubricating composition according to the present invention, (poly)glycerin ethers and (poly)oxyalkyleneglycol ethers as the component (B) may be used alone or in combinations of at least two kinds. Although the content of the component (B) is not limited, it is preferably 0.01 to 5 wt %, and more preferably 0.1 to 1 wt % of the base oil for lubricating oil, because an extremely low content does not sufficiently lower friction when water is included, whereas an excessive content decreases the solubility to oil.

Both (poly)glycerin ether represented by the general formula (4) and (poly)oxyalkylene glycol ether represented by the general formula (5) compounded in the base oil for lubricating oil are not hydrolyzed with water included in the lubricating oil. Thus, such additives are superior to any ester-type additives readily hydrolyzed, and exhibit excellent lubricating properties when they are used with molybdenum compounds.

When a base grease is used in the lubricating composition according to the present invention, (poly)glycerin ethers and (poly)oxyalkyleneglycol ethers as the component (B) may be used alone or in combinations of at least two kinds. Although the content of the component (B) is not limited, it is preferably 0.01 to 10 wt %, and more preferably 1 to 5 wt % of the base grease, because an extremely low content does not sufficiently lower friction, whereas an excessive content does not further improve grease properties, but may be harmful to the base grease.

Both (poly)glycerin ether represented by the general formula (4) and (poly)oxyalkylene glycol ether represented by the general formula (5) compounded in the base grease exhibit excellent lubricating properties when they are used with molybdenum compounds. Additionally, the lubricating composition further comprising ZnDTP and/or ZnDTC exhibits even more improved lubricating properties.

In ZnDTP represented by the general formula (6) as the component (C) usable in the lubricating oil and grease compositions according to the present invention, both $R^{15}$ and $R^{16}$ are each a hydrocarbyl group, both may be the same or different from each other, and preferably an alkyl, alkenyl or alkylaryl group. Among them, an alkyl group having 3 to 14 carbon atoms is more preferable.

In $R^{15}$ and $R^{16}$ in at least one ZnDTP used, 60% or more of the hydrocarbyl group is preferably at least one primary alkyl group, and 40% or less of the hydrocarbyl group may be secondary and/or tertiary alkyl groups.

The prefix a is zero or one-third. The compound is termed neutral ZnDTP when a=0, and termed basic ZnDTP when a=⅓ (one-third).

The ZnDTP used in the lubricating oil and grease compositions according to the present invention can be synthesized by the method described in, for example, Japanese Patent Publication No. 48-37251, in which the compound is obtained by synthesizing an alkyl-substituted dithiophosphoric acid through the reaction of $P_2S_5$ with a predetermined alcohol, and by neutralizing or alkalifying the resultant with zinc oxide to form a zinc salt of the resultant.

The ZnDTPs represented by the general formula (6) as the component (C) can be used alone or in combinations of at least two kinds, in the lubricating oil composition of the present invention. Although the content of the component (C) is not limited, it is preferably 0.001 to 1 wt % as reduced phosphorus amount, more preferably 0.005 to 0.5 wt %, and most preferably 0.01 to 0.15 wt % of the base oil for lubricating oil, because an extremely low content does not have sufficient extreme pressure effect, whereas an excessive content deactivates the catalyst in an exhaust gas catalytic converter due to phosphorus in the ZnDTP.

The ZnDTPs represented by the general formula (6) as the component (C) can be used alone or in combinations of at least two kinds, in the grease composition of the present invention. Although the content of the component (C) is not limited, it is preferably 0.01 to 10 wt %, and more preferably 1 to 5 wt % of the base grease, because an extremely low content does not have sufficient extreme pressure effect, whereas an excessive content decreases lubricating properties.

The ZnDTCs represented by the general formula (7) as the component (C) can also be used in the lubricating oil and grease compositions of the present invention. Both $R^{17}$ and $R^{18}$ in the ZnDTC are each a hydrocarbyl group, and both may be the same or different from each other. Such hydrocarbyl groups preferably include alkyl, alkenyl, and alkylaryl groups similar to $R^1$ through $R^{10}$ as described above, and more preferably alkyl groups having 3 to 14 carbon atoms.

The ZnDTCs represented by the general formula (7) as the component (C) can be used alone or in combinations of at least two kinds, in the lubricating oil and grease compositions of the present invention. Although the content of the component (C) is not limited, it is preferably 0.01 to 15 wt %, and more preferably 1 to 5 wt % of the base oil for lubricating oil or base grease, because an extremely low content does not have sufficient extreme pressure effect, whereas an excessive content decreases lubricating properties.

The lubricating composition according to the present invention contains the components (A) and (B) described above as essential constituents, and may further contain the optional component (C), the base oil for lubricating oil and base grease.

Examples of usable base oil for lubricating oil include mineral oils and synthetic oils. The term mineral oils used here means those obtained from crude oil through separation, distillation and purification, and includes paraffinic oils, naphthenic oils, their hydrogenated oils, their purified oils, and hydrogenolyzed VHVI oils. The term synthetic oils used here means chemically synthesized lubricating oils, and include poly-α-olefins, polyisobutylene or polybutene, diesters, polyol esters, phosphate esters, silicate esters, polyalkyleneglycols, polyphenylethers, silicones, fluorides, alkylbenzene and the like.

The base grease that can be used in the present invention comprises a base oil and a thickener. Examples of thickeners include metallic soaps containing metallic components, such as aluminum, barium, calcium, lithium, and sodium; complex soaps, such as a lithium complex, calcium complex, and aluminum complex; organic non-soap thickeners, such as urea, diurea, triurea, tetraurea, arylureas, and terephthalamates; and inorganic non-soap thickeners, such as bentonite, and silica aero gels. Among them, urea is preferably used. Such thickeners can be used alone or in combination. Although the content of the thickener is not limited, it is preferably 3 to 40 wt %, and more preferably 5 to 20 wt % of the base grease comprising the base oil and the thickener.

Examples of usable base oils in the grease composition in accordance with the present invention include various base oils for lubricating oil, e.g. mineral lubricating base oils, synthetic lubricating base oils, and mixtures thereof. Mineral oils are generally prepared by purifying crude oil through solvent and/or hydrogenation purification processes, as well as other purification processes. Examples of suitable synthetic lubricating base oils include α-olefinic polymers having 3 to 12 carbon atoms, e.g. α-olefinic oligomers; dialkyl diesters having 4 to 12 carbon atoms, e.g. sebacates, such as 2-ethylhexyl sebacate and dioctyl sebacate, azelates, and adipates; polyol esters, e.g. esters obtained by the reaction of trimethylolpropane or pentaerythritol with monobasic acids having 3 to 12 carbon atoms; alkylbenzenes having 9 to 40 carbon atoms; polyglycols obtained by condensation of butyl alcohol with propylene oxide; and phenyl ethers having 2 to 5 ether sequences and 3 to 6 phenylene segments. The mineral and synthetic lubricating base oils can be used alone or in combination. The amount of the base oil to be compounded is adequately determined depending on required properties and is generally 70 to 95 wt % of the base grease comprising the base oil and the thickener.

Any well known additives can be incorporated within the object in accordance with the present invention, if necessary. In the lubricating oil composition, examples of such additives include friction reducers, e.g. higher fatty acids, higher alcohols, amines, and esters; sulfur-containing, chlorine-containing, phosphorus-containing, and organometallic extreme pressure agents; phenolic and amine antioxidants; neutral or highly basic alkaline earth metal sulfonates; carboxylate detergents; dispersants, e.g. succinic imide and benzyl amine; viscosity index improvers, e.g. high molecular weight poly(meth)acrylates, polyisobutylenes, polystyrenes, ethylene-propylene copolymers, and styrene-isobutylene copolymers; ester and silicone antifoaming agents; corrosion inhibitors; and flow-point decreasers. These additives may be used in an amount within usual usage.

On the other hand, in the grease composition, examples of additives include friction reducers, e.g. higher fatty acids, higher alcohols, amines, and esters; sulfur-, chlorine-, phosphorus-, and lead-containing extreme pressure agents; phenolic, amine, sulfur-containing and selenium-containing antioxidants; corrosion inhibitors, e.g. long-chain carboxylic acids and their derivatives, sulfonate salts, amines, and phosphate esters; solid lubricants, e.g. graphite, molybdenum disulfide, polyethylene, polytetrafluoroethylene (PTFE), and boron nitride; and other miscellaneous additives, e.g. flow-point reducers, viscosity index improvers, tackifiers, structure stabilizers, detergent-dispersants, antiseptic agents, antifoaming agents, ester friction reducers, coloring agents, sulfur- or chlorine-containing and organometallic extreme pressure agents, neutral and highly basic alkaline earth metal detergents, antistatic agents, emulsifiers, and demulsifiers. These additives may be used in an amount within usual usage.

The lubricating oil compositions in accordance with the present invention can be used as lubricating oils for internal combustion engines, e.g. vehicle engines including automobile engines, two cycle engines, aircraft engines, seacraft engines, and locomotive engines (such engines including gasoline, diesel, gas, turbine engines); automobile transmission fluids; trans-axle lubricants; gear lubricants, and metal working lubricants.

The lubricating grease composition in accordance with the present invention can be preferably used for universal joints including constant velocity joints, constant velocity gears, and speed change gears.

As described above, the present invention can provide a lubricating oil composition exhibiting a continuous friction decreasing effect against the deterioration due to included water by means of the combination of a base oil for lubricating oil, a molybdenum compound, a (poly)glycerin ether and/or (poly)oxyalkylene glycol ether, and optionally ZnDTP and/or ZnDTC.

Additionally, the present invention can provide a grease composition exhibiting excellent friction and abrasion characteristics by means of the combination of a base grease, a molybdenum compound, a (poly)glycerin ether and/or (poly)oxyalkylene glycol ether, and optionally ZnDTP and/or ZnDTC.

EXAMPLES

The lubricating composition in accordance with the present invention will now be explained in detail based on the following illustrative examples.

Materials used in Inventive products and Comparative products are as follows:

Base oil for lubricating oil: Mineral oil type high VI oil obtained by hydrogenolysis of raw mineral oil from crude oil. Kinematic viscosity: 4.1 cSt at 100° C., and VI: 126.

Base Grease: An aliphatic amine-type urea compound as a thickener was homogeneously dispersed in a purified mineral oil having a viscosity of 15 cSt at 100° C., so that the final viscosity became 287 cSt at 25° C.

Component (A)

Mo Compound 1: MoDTP in which $R^5$ through $R^8$ are each an 2-ethylhexyl group, and the S/O ratio in $X^2$ is 2.2 in the general formula (2).

Mo Compound 2: MoDTC in which $R^1$ through $R^4$ are each an 2-ethylhexyl group, and the S/O ratio in $X^1$ is 2.2 in the general formula (1).

Mo Compound 3: MoDTC in which $R^1$ through $R^4$ are each 2-ethylhexyl or isotridecyl groups, the ratio of the 2-ethylhexyl group to the isotridecyl group is 1:1, and the S/O ratio in $X_1$ is 2.2 in the general formula (1).

Mo Compound 4: MoAm compound synthesized by the following process:

In a nitrogen flow, one mole of molybdenum trioxide was dispersed into 540 ml of water, and then 2 mole of ditridecylamine was dropped into the dispersion in one hour and further aged for one hour while maintaining the temperature at 50° to 60° C. A light blue oily amine salt of molybdate (MoAm) was obtained by removing the aqueous layer, in which $R^9$ and $R^{10}$ are tridecyl groups. Said MoAm is a mixture wherein b is 0.95 to 1.05, and c is 0 to 1, in the general formula (8). The values of b and c were estimated.

Mo Compound 5: MoDTC in which $R^1$ through $R^4$ are n-butyl groups, and the S/O ratio in $X^1$ is 2.2 in the general formula (1).

Component (B)

Glycerin Ether 1: Glycerin monooleyl ether [$R^{11}$ is an oleyl group, $R^{12}$ is a hydrogen atom, and n is 1 in the general formula (4)].

Glycerin Ether 2: Glycerin dioleyl ether [$R^{10}$ and $R^{12}$ are oleyl groups, and n is 1 in the general formula (4)].

Glycerin Ether 3: Glycerin monostearyl ether [$R^{11}$ is a stearyl group, $R^{12}$ is a hydrogen atom, and n is 1 in the general formula (4)].

Glycerin Ether 4: Triglycerin monooleyl ether [$R^{11}$ is an oleyl group, $R^{12}$ is a hydrogen atom, and n is 3 in the general formula (4)].

Glycerin Ether 5: Glycerin monolauryl ether [$R^{11}$ is a lauryl group, $R^{12}$ is a hydrogen atom, and n is 1 in the general formula (4)].

Glycerin Ether 6: Diglycerin monomyristyl ether [$R^{11}$ is a myristyl group, $R^{12}$ is a hydrogen atom, and n is 2 in the general formula (4)].

Glycerin Ether 7: Diglycerin monolauryl ether [$R^{11}$ is a lauryl group, $R^{12}$ is a hydrogen atom, and n is 2 in the general formula (4)].

Component (B)

Ether 1: Lauryl alcohol ethoxylate [$R^{13}$ is a lauryl group, $R^{14}$ is an ethylene group, and m is 3, in the general formula (5)].

Ether 2: Oleyl alcohol ethoxylate [$R^{13}$ is an oleyl group, $R^{14}$ is an ethylene group, and m is 3, in the general formula (5)].

Ether 3: Lauryl alcohol propoxylate [$R^{13}$ is a lauryl group, $R^{14}$ is a propylene group, and m is 4, in the general formula (5)].

Ether 4: Oleyl alcohol propoxylate [$R^{13}$ is an oleyl group, $R^{14}$ is a propylene group, and m is 2, in the general formula (5)].

Ether 5: Octyl alcohol butoxylate [$R^{13}$ is an octyl group, $R^{14}$ is a butylene group, and m is 8, in the general formula (5)].

Ether 6: Myristyl alcohol ethoxypropoxylate [$R^{13}$ is a myristyl group, $R^{14}$ is a 2:1 mixture of ethylene group:propylene group, and m is 3, in the general formula (5)].

Ether 7: Lauryl alcohol ethoxypropoxylate [$R^{13}$ is a lauryl group, $R^{14}$ is an ethylene and propylene groups, and m is 1 or 3, in the general formula (5)].

Glycerin Ester 1: Glycerin monooleate

Glycerin Ester 2: Diglycerin monooleate

Glycerin Ester 3: Glycerin distearate

Glycerin Ester 4: Glycerin monolaurate

Glycerin Ester 5: Glycerin dioleate

Ester 6: Sorbitan monooleate

Ester 7: Sorbitan trioleate

Component (C)

ZnDTP 1: $R^{15}$ and $R^{16}$ are 2-ethylhexyl groups (primary alkyl group), and the molar ratio of neutral (a=0) salt to basic salt (a=⅓) is 55:45, in the general formula (6).

ZnDTP 2: $R^{15}$ and $R^{16}$ are dodecyl groups (primary alkyl group), and the molar ratio of neutral salt to basic salt is 62:38, in the general formula (6).

ZnDTP 3: $R^{15}$ and $R^{16}$ are 1:1 of secondary hexyl and isopropyl groups, and the molar ratio of neutral salt to basic salt is 62:38, in the general formula (6).

ZnDTP 4: $R^{15}$ and $R^6$ are 1:1 of 1,3-dimethylbutyl group (secondary alkyl group) and isopropyl group (secondary alkyl group), and the molar ratio of neutral salt to basic salt is 62:38, in the general formula (6).

ZnDTC 1: $R^{17}$ and $R^{18}$ are 2-ethylhexyl groups in the general formula (7).

ZnDTC 2: $R^{19}$ and $R^{20}$ are 1:1 of 1,3-dimethylbutyl group and isopropyl group in the general formula (7).

EXAMPLE 1

Inventive lubricating oil compositions and comparative lubricating oil compositioms were prepared by compounding based on the formulations shown in Tables 1 to 3. In these tables, the figures refer to wt % as reduced molybdenum amount in the base oil for lubricating oil for the Mo compound, wt % for glycerin ether and glycerin ester, and wt % as reduced phosphorus amount for ZnDTP, respectively.

The stability against hydrolysis of the lubricating oil compositions was evaluated as follows:

Hydrolysis of Lubricating Oil Composition

Into each lubricating oil composition, 0.2 wt % of water was added and the composition was preserved for one week at 93° C. to be used in the following friction coefficient measurement:

Friction Coefficient Measurement

The friction coefficient measurement was carried out with an SRV tester under the following conditions:

Line Contact: The test was carried out in a line contact, in other words, cylinder-on-plate method. An upper cylinder (15 mmϕ×22 mm) was set on a plate (24 mmϕ×7.85 mm) in the sliding direction, and reciprocated for 15 minutes to evaluate the friction coefficient. Both were made of stainless steel SUJ-2.

Load: 200N

Temperature: 80 ° C.

Test Duration: 15 minutes

Vibrational amplitude: 1 mm

Cycle: 50 Hz

Results are shown in Tables 1 to 3.

TABLE 1

| | Inventive Products | | | | | | | | | | | | | | | | |
|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 |
| Mo Compound 1 | | | 0.01 | | | | 0.03 | 0.02 | 0.1 | 0.04 | 0.04 | | | | | | |
| Mo Compound 2 | | | | | | | 0.05 | | | | | 0.08 | 0.08 | 0.08 | 0.08 | 0.08 | 0.02 |
| Mo Compound 3 | 0.08 | 0.08 | 0.07 | 0.08 | 0.08 | 0.08 | | | | | 0.04 | | | | | | |
| Mo Compound 4 | | | | | | | | | | | | | | | | | |
| Glycerin Ether 1 | 0.5 | 0.5 | 0.5 | | | | | 0.5 | | 0.5 | 0.3 | 0.5 | 0.5 | | | | 0.2 |
| Glycerin Ether 2 | | | | 0.4 | | | | | | | | | | | 1.0 | 0.5 | |
| Glycerin Ether 3 | | | | | 0.5 | | 0.5 | | | | | | | | | | |
| Glycerin Ether 4 | | | | | | 0.5 | | | | | | | | | | | |
| Glycerin Ether 5 | | | | | | | | | 0.5 | | | | | 0.1 | | | |
| Glycerin Ether 6 | | | | | | | | | | | | | | | | | |
| ZnDTP 1 | | 0.07 | 0.05 | 0.05 | 0.07 | 0.07 | 0.06 | 0.07 | 0.07 | 0.08 | | 0.07 | 0.01 | 0.07 | 0.045 | 0.06 | 0.07 |
| ZnDTP 2 | | | 0.02 | 0.02 | | | | | | | 0.08 | | | | | | |
| ZnDTP 3 | | | | | | | 0.01 | | | | | | | | 0.025 | 0.01 | |
| Precipitation | None | None | None | None | None | None | None | None | None | None | None | None | None | None | None | None | None |
| Friction Coefficient | | | | | | | | | | | | | | | | | |
| Before Use | 0.065 | 0.05 | 0.04 | 0.045 | 0.05 | 0.05 | 0.05 | 0.05 | 0.045 | 0.04 | 0.05 | 0.04 | 0.05 | 0.05 | 0.05 | 0.05 | 0.04 |
| After Deterioration | 0.08 | 0.055 | 0.045 | 0.05 | 0.055 | 0.055 | 0.06 | 0.055 | 0.05 | 0.045 | 0.055 | 0.045 | 0.055 | 0.055 | 0.06 | 0.06 | 0.045 |

TABLE 2

| | Inventive Product | | | | | | | | | | | | | | | |
|---|---|---|---|---|---|---|---|---|---|---|---|---|---|---|---|---|
| | 18 | 19 | 20 | 21 | 22 | 23 | 24 | 25 | 26 | 27 | 28 | 29 | 30 | 31 | 32 | 33 |
| Mo Compound 1 | | | | | | | | | | | | | | | | |
| Mo Compound 2 | | | | | | | | | | | | 0.08 | 0.08 | | | |
| Mo Compound 3 | 0.08 | 0.08 | 0.1 | 0.1 | 0.08 | 0.05 | 0.15 | 0.1 | 0.1 | 0.04 | 0.04 | | | 0.08 | 0.08 | 0.08 |
| Mo Compound 4 | | | | | | | | | 0.08 | 0.04 | 0.04 | | | | | |
| Glycerin Ether 1 | 0.2 | | 2.0 | 0.5 | 0.5 | 0.5 | 0.5 | 0.3 | 0.5 | | 0.2 | | 0.5 | 0.2 | | |
| Glycerin Ether 2 | 0.3 | | | | | | | | | | | | | | | |
| Glycerin Ether 3 | | 0.07 | 1.0 | | | | | 0.3 | | | | | | | | |
| Glycerin Ether 4 | | | | | | | | | | 0.5 | | | | | | |
| Glycerin Ether 5 | | | | | | | | | | | 0.2 | | | | | |
| Glycerin Ether 6 | | | | | | | | | | | | 1.0 | | 0.3 | 0.5 | 1.0 |
| ZnDTP 1 | 0.07 | | 0.04 | 0.07 | | 0.02 | 0.14 | | 0.07 | 0.07 | | | | | 0.1 | 0.05 |
| ZnDTP 2 | | 0.07 | 0.03 | | 0.07 | 0.01 | | 0.07 | | | 0.07 | | | | | |
| ZnDTP 3 | | | | | | | | | | | 0.04 | | | | | |
| Precipitation | None | None | None | None | None | None | None | None | None | None | None | None | None | None | None | None |
| Friction Coefficient | | | | | | | | | | | | | | | | |
| Before Use | 0.04 | 0.04 | 0.55 | 0.04 | 0.04 | 0.05 | 0.07 | 0.05 | 0.04 | 0.05 | 0.05 | 0.07 | 0.075 | 0.07 | 0.04 | 0.045 |
| After Deterioration | 0.045 | 0.045 | 0.06 | 0.045 | 0.05 | 0.055 | 0.08 | 0.04 | 0.045 | 0.055 | 0.06 | 0.075 | 0.085 | 0.075 | 0.045 | 0.05 |

TABLE 3

| | Comparative Products | | | | | | | |
|---|---|---|---|---|---|---|---|---|
| | 1 | 2 | 3 | 4 | 5 | 6 | 7 | 8 |
| Mo Compound 1 | 0.08 | | | | | | | |
| Mo Compound 2 | | | | | | | | |
| Mo Compound 3 | | | | 0.08 | 0.08 | 0.08 | 0.08 | 0.08 |
| Mo Compound 4 | | | | | | | | |
| Glycerin Ether 1 | | 0.5 | 0.5 | | | | | |
| Glycerin Ether 2 | | | | | | | | |
| Glycerin Ether 3 | | | | | | | | |
| Glycerin Ether 4 | | | | | | | | |
| Glycerin Ether 5 | | | | | | | | |
| Glycerin Ether 6 | | | | | | | | |
| Glycerin Ester 1 | | | | 0.5 | | | 0.5 | |
| Glycerin Ester 2 | | | | | 0.5 | | | |
| Glycerin Ester 3 | | | | | | 0.5 | | |
| Glycerin Ester 4 | | | | | | | | 0.5 |
| ZnDTP 1 | | | | | | | | |
| ZnDTP 2 | | | 0.07 | | | | 0.07 | |
| ZnDTP 3 | | | | | | | | |
| Precipitation | Found | None | Found | Found | Found | Found | None | Found |

TABLE 3-continued

| | Comparative Products | | | | | | | |
|---|---|---|---|---|---|---|---|---|
| | 1 | 2 | 3 | 4 | 5 | 6 | 7 | 8 |
| Friction Coefficient | | | | | | | | |
| Before Use | 0.075 | 0.1 | 0.085 | 0.055 | 0.060 | 0.055 | 0.045 | 0.06 |
| After Deterioration | 0.125 | 0.15 | 0.15 | 0.09 | 0.11 | 0.125 | 0.090 | 0.125 |

EXAMPLE 2

Inventive lubricating oil compositions and comparative lubricating oil compositions were prepared by compounding based on the formulations shown in Tables 4 to 6. In these tables, the figures refer to wt % as reduced molybdenum amount in the lubricating base oil for the Mo compound, wt % for glycerin ether and glycerin ester, and wt % as reduced phosphorus amount for ZnDTP, respectively.

Each composition was subjected to the measurements of stability against hydrolysis and the friction coefficient, similar to Example 1.

Results are shown in Tables 4 to 6.

TABLE 4

| Inventive Products | 34 | 35 | 36 | 37 | 38 | 39 | 40 | 41 | 42 | 43 | 44 | 45 | 46 | 47 | 48 | 49 |
|---|---|---|---|---|---|---|---|---|---|---|---|---|---|---|---|---|
| Mo Compound 1 | | | 0.01 | | | | 0.01 | | 0.02 | | 0.02 | 0.02 | | 0.08 | | |
| Mo Compound 2 | | | | | | | 0.06 | | | 0.07 | 0.03 | | | | 0.02 | 0.03 |
| Mo Compound 3 | 0.07 | 0.07 | 0.07 | 0.07 | 0.07 | 0.07 | | 0.07 | 0.05 | | | 0.02 | 0.07 | 0.1 | | 0.05 |
| Mo Compound 4 | | | | | | | | | | | | | | | | |
| Ether 1 | 0.5 | 0.5 | 0.5 | | | | | 0.5 | 0.3 | 0.2 | 0.5 | | 0.005 | 1.0 | | 0.2 |
| Ether 2 | | | | 0.5 | | | | | | | | | | | | 0.3 |
| Ether 3 | | | | | 0.5 | | | | | | | | | | 0.4 | |
| Ether 4 | | | | | | 0.5 | 0.5 | | | | | | | | | |
| Ether 5 | | | | | | | | | | 0.3 | | 0.2 | | | | |
| ZnDTP 1 | | 0.07 | 0.05 | 0.05 | 0.07 | 0.07 | 0.04 | 0.07 | 0.07 | 0.06 | 0.07 | 0.01 | 0.07 | 0.05 | 0.07 | 0.07 |
| ZnDTP 2 | | | 0.02 | 0.02 | | | 0.03 | | | 0.01 | | | | 0.01 | | |
| ZnDTP 4 | | | | | | | | | | | | | | | | 0.01 |
| Glycerin Ether 1 | | | | | | | | | | | | | | | | |
| Glycerin Ether 6 | | | | | | | | | | | | | | | | |
| Glycerin Ester 1 | | | | | | | | | | | | | | | | |
| Glycerin Ester 5 | | | | | | | | | | | | | | | | |
| Glycerin Ester 4 | | | | | | | | | | | | | | | | |
| Precipitation | None | None | None | None | None | None | None | None | None | None | None | None | None | None | None | None |
| Friction Coefficient | | | | | | | | | | | | | | | | |
| Before Use | 0.06 | 0.05 | 0.045 | 0.045 | 0.05 | 0.055 | 0.05 | 0.05 | 0.045 | 0.05 | 0.055 | 0.055 | 0.05 | 0.065 | 0.06 | 0.05 |
| After Deterioration | 0.075 | 0.055 | 0.045 | 0.05 | 0.05 | 0.055 | 0.055 | 0.055 | 0.055 | 0.06 | 0.055 | 0.055 | 0.055 | 0.065 | 0.065 | 0.06 |

TABLE 5

| Inventive Products | 50 | 51 | 52 | 53 | 54 | 55 | 56 | 57 | 58 | 59 | 60 | 61 | 62 | 63 | 64 | 65 |
|---|---|---|---|---|---|---|---|---|---|---|---|---|---|---|---|---|
| Mo Compound 1 | | | | | | | | | | | | | | | | |
| Mo Compound 2 | 0.01 | 0.02 | 0.08 | | | | | | | | | | | | | 0.4 |
| Mo Compound 3 | 0.02 | 0.01 | | 0.05 | 0.02 | 0.05 | 0.02 | 0.07 | 0.07 | 0.07 | 0.07 | 0.07 | 0.07 | 0.5 | 0.07 | 0.1 |
| Mo Compound 4 | | | | | | 0.02 | 0.01 | | | | | | | | | |
| Ether 1 | 0.2 | 0.6 | 1.0 | | 0.05 | | 0.3 | | | | | 5.0 | | | | |
| Ether 2 | | | | 0.2 | 0.5 | | | 0.5 | | | | | | | | |
| Ether 3 | 0.1 | | 2.0 | | | 0.5 | | | 0.5 | | | | | | | |
| Ether 4 | | | | | | | 0.2 | | | 0.5 | | | | | | |
| Ether 5 | | | | | | | | | | | 0.5 | | | | | |
| ZnDTP 1 | 0.01 | 0.02 | | | 0.005 | | 0.02 | | | | | | | | 0.5 | 0.05 |
| ZnDTP 2 | 0.04 | | 0.05 | 0.05 | | 0.07 | 0.01 | | | | | | | | | |
| ZnDTP 4 | | | 0.01 | 0.02 | | | | | | | | | | | | |
| Glycerin Ether 1 | | | | | | | | | | | | | | 0.5 | 0.5 | 0.5 |
| Glycerin Ether 6 | | | | | | | | | | | | | 0.5 | | | |
| Glycerin Ester 1 | | | | | | | | | | | | | | | | |
| Glycerin Ester 5 | | | | | | | | | | | | | | | | |
| Glycerin Ester 4 | | | | | | | | | | | | | | | | |
| Precipitation | None | None | None | None | None | None | None | None | None | None | None | None | None | None | None | None |
| Friction Coefficient | | | | | | | | | | | | | | | | |
| Before Use | 0.055 | 0.055 | 0.06 | 0.055 | 0.065 | 0.055 | 0.05 | 0.06 | 0.065 | 0.065 | 0.06 | 0.06 | 0.06 | 0.05 | 0.05 | 0.05 |
| After Deterioration | 0.065 | 0.065 | 0.07 | 0.07 | 0.07 | 0.055 | 0.055 | 0.075 | 0.075 | 0.08 | 0.075 | 0.065 | 0.065 | 0.055 | 0.055 | 0.055 |

TABLE 6

| Comparative Products | 9 | 10 | 11 | 12 | 13 | 14 | 15 |
|---|---|---|---|---|---|---|---|
| Mo Compound 1 | 0.07 | | | | | | |
| Mo Compound 2 | | | | | | | |
| Mo Compound 3 | | | | 0.07 | 0.07 | 0.07 | 0.07 |
| Mo Compound 4 | | | | | | | |
| Ether 1 | | 0.5 | 0.5 | | | | |
| Ether 2 | | | | | | | |
| Ether 3 | | | | | | | |
| Ether 4 | | | | | | | |
| Ether 5 | | | | | | | |
| ZnDTP 1 | | | | | | | |
| ZnDTP 2 | | | 0.07 | | | | 0.07 |
| ZnDTP 4 | | | | | | | |
| Glycerin Ether 1 | | | | | | | |
| Glycerin Ether 6 | | | | | | | |
| Glycerin Ester 1 | | | | 0.5 | | | 0.5 |
| Glycerin Ester 5 | | | | | 0.5 | | |
| Glycerin Ester 4 | | | | | | 0.5 | |
| Precipitation | Found | None | Found | Found | Found | Found | Found |
| Friction Coefficient | | | | | | | |
| Before Use | 0.075 | 0.1 | 0.095 | 0.055 | 0.060 | 0.055 | 0.045 |
| After Deterioration | 0.125 | 0.15 | 0.15 | 0.09 | 0.11 | 0.125 | 0.090 |

EXAMPLE 3

Inventive grease compositions and comparative grease compositions were prepared by compounding based on formulations shown in Tables 7 to 9. In these tables, the figures refer to wt % in the base grease.

Each composition was subjected to the measurements of the friction coefficient based on the following conditions:

Friction Coefficient Measurement

Point Contact: The test was carried out in a point contact, in other words, ball-on-plate method. An upper ball (10 mmϕ) was set on a plate (24 mmϕ×7.85 mm), and reciprocated for 2 hours to evaluate the friction coefficient. Both were made of stainless steel SUJ-2.

Load: 200N

Temperature: 50° C.

Test Duration: 2 hours

Vibrational amplitude: 1 mm

Cycle: 50 Hz

Wear Resistance Measurement

The friction coefficient and wear track were evaluated using a high speed four-ball tester, under the following conditions:

Rotation: 1,800 rpm

Load: 40 kg

Temperature: 40° C.

Time: 60 minutes

Results are shown in Tables 7 to 9.

TABLE 7

| Inventive Products | 66 | 67 | 68 | 69 | 70 | 71 | 72 | 73 | 74 | 75 | 76 | 77 | 78 | 79 |
|---|---|---|---|---|---|---|---|---|---|---|---|---|---|---|
| Component A | | | | | | | | | | | | | | |
| Mo Compound 2 | | | | | | | | | | 3.0 | | | | |
| Mo Compound 1 | | | | | | | | | | | 3.0 | | | |
| Mo Compound 3 | | | | | | | | | | | | 3.0 | | |
| Mo Compound 5 | 3.0 | 3.0 | 3.0 | 3.0 | 3.0 | 3.0 | 3.0 | 3.0 | 3.0 | | | | | 3.0 |
| Mo Compound 4 | | | | | | | | | | | | | 3.0 | |
| Component B | | | | | | | | | | | | | | |
| Glycerin Ether 1 | 3.0 | | | | | | | | | 3.0 | 3.0 | 3.0 | 3.0 | 3.0 |
| Glycerin Ether 2 | | 3.0 | | | | | | | | | | | | |
| Glycerin Ether 5 | | | 3.0 | | | | | | | | | | | |
| Glycerin Ether 7 | | | | 3.0 | | | | | | | | | | |
| Glycerin Ether 3 | | | | | 3.0 | | | | | | | | | |
| Ether 1 | | | | | | 3.0 | | | | | | | | |
| Ether 2 | | | | | | | 3.0 | | | | | | | |
| Ether 7 | | | | | | | | 3.0 | | | | | | |
| Ether 4 | | | | | | | | | 3.0 | | | | | |
| Component C | | | | | | | | | | | | | | |
| ZnDTP 1 | | | | | | | | | | | | | | 3.0 |
| ZnDTP 2 | | | | | | | | | | | | | | |
| ZnDTP 4 | | | | | | | | | | | | | | |
| ZnDTC 1 | | | | | | | | | | | | | | |
| ZnDTC 2 | | | | | | | | | | | | | | |
| SRV Friction Coefficient | 0.075 | 0.07 | 0.07 | 0.075 | 0.075 | 0.075 | 0.08 | 0.07 | 0.072 | 0.075 | 0.079 | 0.077 | 0.078 | 0.60 |

TABLE 7-continued

| Inventive Products | 66 | 67 | 68 | 69 | 70 | 71 | 72 | 73 | 74 | 75 | 76 | 77 | 78 | 79 |
|---|---|---|---|---|---|---|---|---|---|---|---|---|---|---|
| High Speed Four-ball Test | | | | | | | | | | | | | | |
| Friction Coefficient | 0.052 | 0.051 | 0.052 | 0.055 | 0.05 | 0.051 | 0.057 | 0.051 | 0.055 | 0.058 | 0.057 | 0.057 | 0.059 | 0.040 |
| Abrasion Scar (mm) | 0.66 | 0.64 | 0.67 | 0.61 | 0.6 | 0.65 | 0.68 | 0.65 | 0.6 | 0.65 | 0.62 | 0.67 | 0.70 | 0.60 |

TABLE 8

| Inventive Products | 80 | 81 | 82 | 83 | 84 | 85 | 86 | 87 | 88 | 89 | 90 | 91 | 92 | 93 |
|---|---|---|---|---|---|---|---|---|---|---|---|---|---|---|
| Component A | | | | | | | | | | | | | | |
| Mo Compound 2 | | 3.0 | | | | | | | 3.0 | | | | | |
| Mo Compound 1 | | | | 3.0 | | | | | | | | 5.0 | | |
| Mo Compound 3 | | | 3.0 | | | | | | | | 10.0 | | | 3.0 |
| Mo Compound 5 | 3.0 | | | | 3.0 | | 3.0 | 3.0 | | 0.01 | | | | 3.0 |
| Mo Compound 4 | | | | | | 3.0 | | | | | | | 5.0 | |
| Component B | | | | | | | | | | | | | | |
| Glycerin Ether 1 | | | | | | | 0.01 | | | | | | | |
| Glycerin Ether 2 | | 3.0 | | | | | | 10.0 | | | | | | |
| Glycerin Ether 5 | 3.0 | | | | | | | | 5.0 | | | | | |
| Glycerin Ether 7 | | | | 3.0 | | | | | | 5.0 | | | | |
| Glycerin Ether 3 | | | 3.0 | | | | | | | | | | | 3.0 |
| Ether 1 | | | | | 3.0 | | | | | | 3.0 | | | 3.0 |
| Ether 2 | | | | | | | | | | | | | 5.0 | |
| Ether 7 | | | | | | | | | | | | | | |
| Ether 4 | | | | | | 3.0 | | | | | | 5.0 | | |
| Component C | | | | | | | | | | | | | | |
| ZnDTP 1 | | | | | 3.0 | 3.0 | 3.0 | 3.0 | | 3.0 | | 0.01 | | |
| ZnDTP 2 | 3.0 | | | | | | | | 3.0 | | | | | 5.0 |
| ZnDTP 4 | | | 3.0 | | | | | | | | | | | |
| ZnDTC 1 | | 3.0 | | | 3.0 | | | | | | 3.0 | | 10.0 | |
| ZnDTC 2 | | | | 3.0 | | | | | | | | | | |
| SRV Friction Coefficient | 0.070 | 0.065 | 0.055 | 0.065 | 0.06 | 0.055 | 0.060 | 0.055 | 0.05 | 0.075 | 0.065 | 0.070 | 0.070 | 0.05 |
| High Speed Four-ball Test | | | | | | | | | | | | | | |
| Friction Coefficient | 0.04 | 0.050 | 0.047 | 0.049 | 0.045 | 0.032 | 0.042 | 0.045 | 0.042 | 0.048 | 0.045 | 0.05 | 0.052 | 0.050 |
| Abrasion Scar (mm) | 0.53 | 0.57 | 0.53 | 0.55 | 0.5 | 0.50 | 0.52 | 0.52 | 0.49 | 0.53 | 0.51 | 0.55 | 0.57 | 0.43 |

TABLE 9

| Comparative Products | | 16 | 17 | 18 | 19 | 20 | 21 |
|---|---|---|---|---|---|---|---|
| Component A | Mo Compound 2 | | | | | | |
| | Mo Compound 1 | | | | | 3.0 | |
| | Mo Compound 3 | | | | | | |
| | Mo Compound 5 | 3.0 | | | 3.0 | | 3.0 |
| | Mo Compound 4 | | | | | | |
| Component B | Glycerin Ether 1 | | | 3.0 | | | |
| | Glycerin Ether 2 | | | | | | |
| | Glycerin Ether 5 | | | | | | |
| | Glycerin Ether 7 | | | | | | |
| | Glycerin Ether 3 | | | | | | |
| | Ether 1 | | 3.0 | | | | |
| | Ether 2 | | | | | | |
| | Ether 7 | | | | | | |
| | Ether 4 | | | | | | |
| Component C | ZnDTP 1 | | | | 3.0 | | 3.0 |
| | ZnDTP 2 | | | | | | |
| | ZnDTP 4 | | | | | | |
| | ZnDTC 1 | | | | | 3.0 | |
| | ZnDTC 2 | | | | | | |
| Others | Ester 6 | | | | 3.0 | | |
| | Ester 7 | | | | | 3.0 | |
| | Ester 1 | | | | | | 3.0 |
| SRV Friction Coefficient | | 0.095 | 0.125 | 0.11 | 0.08 | 0.08 | 0.085 |
| High Speed | Friction Coefficient | 0.085 | 0.105 | 0.115 | 0.07 | 0.06 | 0.095 |

TABLE 9-continued

| Comparative Products | | 16 | 17 | 18 | 19 | 20 | 21 |
|---|---|---|---|---|---|---|---|
| Four-ball Test | Abrasion Scar (mm) | 0.75 | 0.95 | 0.95 | 0.75 | 0.73 | 0.77 |

What is claimed is:

1. A lubricating composition comprising a base oil as a lubricating oil and the following components as additives:

a component (A) comprising at least one molybdenum compound selected from the group consisting of sulfurized oxymolybdenum dithiocarbamates represented by the following general formula:

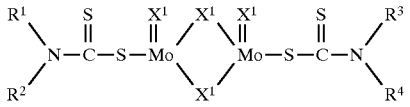

(1)

wherein $R^1$, $R^2$, $R^3$ and $R^4$ are independent hydrocarbyl groups, and $X^1$ represents an oxygen or sulfur atom;

sulfurized oxymolybdenum dithiophosphates represented by the following general formula:

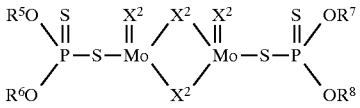

(2)

wherein $R^5$, $R^6$, $R^7$ and $R^8$ are independent hydrocarbyl groups, and $X^2$ represents an oxygen or sulfur atom; and molybdenum amine compounds obtained by reacting a hexavalent molybdenum compound with an amine compound represented by the following general formula:

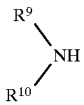

(3)

wherein both $R^9$ and $R^{10}$ represent a hydrogen atom and/or hydrocarbyl group, and $R^9$ and $R^{10}$ are not hydrogen atoms at the same time and a component (B) comprising a glycerin ether represented by the following general formula:

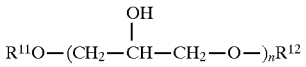

(4)

wherein both $R^{11}$ and $R^{12}$ represent a hydrogen atom and/or hydrocarbyl group with the proviso that $R^{11}$ and $R^{12}$ are not hydrogen atoms at the same time, and n ranges from 1 to 10; and/or an oxyalkylene glycol monoalkyl ether represented by the following general formula:

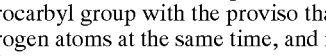

(5)

wherein $R^{13}$ represents a $C_{12}$–$C_{20}$ hydrocarbon group, $R^{14}$ represents an alkylene group, and m ranges from 1 to 10 wherein component (B) is present in an oil soluble and friction reducing amount.

2. The lubricating composition according to claim 1 wherein $R^{13}$ represents an alkyl or alkenyl group having 12 to 20 carbon atoms.

3. The lubricating composition according to claim 1, wherein the component (A) is present in an amount of 0.001 to 1 wt % based on the molybdenum present in the lubricating oil, and the component (B) is present in an amount of 0.01 to 5 wt % in the lubricating oil.

4. The lubricating composition according to claim 1 in the form of a grease, wherein the lubricating composition contains a base grease comprising said base oil and a thickener.

5. The lubricating composition according to claim 4, wherein component (A) is present in an amount of 0.01 to 10 wt % of the base grease, and component (B) is present in an amount of 0.01 to 10 wt % of the base grease.

6. The lubricating composition according to claim 1, wherein in the general formula (4), $R^{11}$ and $R^{12}$ are hydrogen atoms and/or alkyl or alkenyl groups having 1 to 20 carbon atoms, with the proviso that $R^{11}$ and $R^{12}$ cannot both be hydrogen atoms at the same time, and n ranges from 1 to 3.

7. The lubricating composition according to claim 1, wherein in the general formula (5), $R^{13}$ is an alkyl or alkenyl group having 12 to 20 carbon atoms, $R^{14}$ is an alkylene group having 2 to 4 carbon atoms, and m ranges from 1 to 5.

8. A lubricating composition comprising a base oil as a lubricant and the following components as additives:

a component (A) comprising at least one molybdenum compound selected from the group consisting of sulfurized oxymolybdenum dithiocarbamates represented by the following general formula:

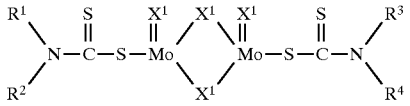

(1)

wherein $R^1$, $R^2$, $R^3$ and $R^4$ are independent hydrocarbyl groups, and $X^1$ represents an oxygen or sulfur atom;

sulfurized oxymolybdenum dithiophosphates represented by the following general formula:

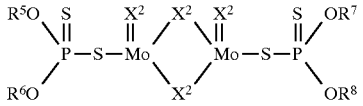

(2)

wherein $R^5$, $R^6$, $R^7$, and $R^8$ are independent hydrocarbyl groups, and $X^2$ represents an oxygen or sulfur atom; and molybdenum amine compounds obtained by reacting a hexavalent molybdenum compound with an amine compound represented by the following general formula:

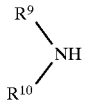

(3)

wherein both $R^9$ and $R^{10}$ represent a hydrogen atom and/or hydrocarbyl group, and $R^9$ and $R^{10}$ are not hydrogen atoms at the same time:

a component (B) comprising a glycerin ether represented by the following general formula:

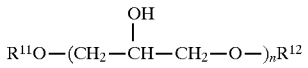

(4)

wherein both $R^{11}$ and $R^{12}$ represent a hydrogen atom and/or hydrocarbyl group, $R^{11}$ and $R^{12}$ are not hydrogen atoms at the same time, and n ranges from 1 to 10; and/or an oxyalkylene glycol monoalkyl ether represented by the following general formula:

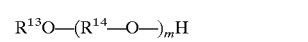

(5)

wherein $R^{13}$ represents a $C_{12}$–$C_{20}$ hydrocarbon group, $R^{14}$ represents an alkylene group, and m ranges from 1 to 10 and a component (C) comprising a zinc dithiophosphate represented by the following general formula:

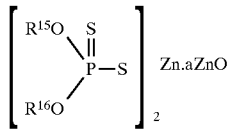

(6)

wherein a represents a figure of zero or one-third, and both $R^{15}$ and $R^{16}$ represent a hydrocarbyl group and/or a zinc dithiocarbamates represented by the following general formula:

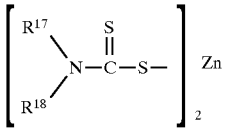

(7)

wherein both $R^{17}$ and $R^{18}$ represent a hydrocarbyl group wherein component (B) is present in an oil soluble and friction reducing amount.

9. The lubricating composition according to claim 2, wherein $R^{13}$ is a lauryl or oleyl group.

10. The lubricating composition according to claim 8, wherein component (A) is present in an amount of 0.001 to 1 wt % of the base oil as molybdenum, component (B) is present in an amount of 0.01 to 5 wt % of the base oil, and component (C) is present in an amount of 0.001 to 1 wt % of the base oil as phosphorus when zinc dithiophosphate is present therein, and/or in an amount of 0.01 to 10 wt % of the base oil when zinc dithiocarbamate is present.

11. The lubricating composition according to claim 8, wherein the lubricating composition is in the form of a grease comprising a base grease made from such base oil and a thickener.

12. The lubricating composition according to claim 11, wherein component (A) is present in an amount of 0.01 to 10 wt % of the base grease, component (B) is present in an amount of 0.01 to 10 wt % of the base grease, and the component (C) is present in an amount of 0.01 to 10 wt % of the base grease.

13. The lubricating composition according to claim 8, wherein in the general formula (4), $R^{11}$ and $R^{12}$ are hydrogen atoms or alkyl or alkenyl groups having 1 to 20 carbon atoms, with the proviso that both $R^{11}$ and $R^{12}$ cannot both be hydrogen atoms at the same time, and n ranges from 1 to 3.

14. The lubricating composition according to claim 8, wherein in the general formula (5), $R^{13}$ is an alkyl or alkenyl group having 12 to 20 carbon atoms, $R^{14}$ is an alkylene group having 2 to 4 carbon atoms, and m ranges from 1 to 5.

15. The lubricating composition according to claim 8 wherein $R^{13}$ represents an alkyl or alkenyl group having 12 to 20 carbon atoms.

16. The lubricating composition according to claim 15, wherein $R^{13}$ is a lauryl or oleyl group.

* * * * *